United States Patent [19]

Nichols

[11] 4,173,794

[45] Nov. 13, 1979

[54] BUCKLELESS BELT

[75] Inventor: Richard D. E. Nichols, Fallbrook, Calif.

[73] Assignee: Bianchi Leather Products, Inc., Temecula, Calif.

[21] Appl. No.: 821,912

[22] Filed: Aug. 4, 1977

[51] Int. Cl.[2] ..... A41F 9/00

[52] U.S. Cl. ..... 2/322; 24/176

[58] Field of Search ..... 2/321, 322, 338, 320; 24/186, 176, 174, 182

[56] References Cited

U.S. PATENT DOCUMENTS

| | | | |
|---|---|---|---|
| 2,342,210 | 2/1944 | Murphey | 2/322 |
| 2,419,662 | 4/1947 | Sutton | 24/186 |
| 2,641,812 | 6/1953 | Boudreau | 24/176 |
| 3,501,775 | 3/1970 | Demers et al. | 2/321 |

FOREIGN PATENT DOCUMENTS

| | | | |
|---|---|---|---|
| 1070355 | 2/1954 | France | 2/338 |

*Primary Examiner*—Doris L. Troutman

*Attorney, Agent, or Firm*—John E. Wagner

[57] ABSTRACT

A buckleless belt employing a closure device or fastening means which positions and holds the two ends of a belt. The closure device virtually completely concealed from the front and affords a minimum additional thickness to the belt in the overlapping region where the fastening means is located. The fastening means comprises a plate member secured to the inner side of the outer end of the belt including guides for aligning the edges of the inner end of the belt. An inwardly depending pin on the plate member spaced longitudinally from the guides engages one of the series of holes in the end region of the inner end of the belt. A looplike belt keeper retains the free inner end in close proximity to the outer end of the belt. The outer end of the belt conceals most or all of the holes in the inner end.

5 Claims, 9 Drawing Figures

BUCKLELESS BELT

BACKGROUND OF THE INVENTION

Although man has been wearing for centuries leather bands to support trousers, the buckle attaching the ends together has been a necessary part of the belt. As a result, throughout the centuries man has attempted to ornament rather than eliminate the buckle. We are all familiar with the high degree of ornamentation or massiveness in size, particularly associated with heavier belts worn in the military, and police organizations. The belt buckle has been considered a necessary evil and despite its extra weight, large polished buckles have been the standard, particularly for police work for many years. Somethings or historically significance are engraved, and other ornamented buckles and likewise have been used for show purposes. These buckles, being unnecessarily heavy and protruding outward, have a tendency to wear clothing or jackets, and in night police work, provide a highly reflective target.

Attempts have been made recently to produce a buckleless belt employing a hook and eye fabric known by the commercial trademark "VELCRO". Such buckleless belts have attained a degree of acceptance but have a major disadvantage in the opening producing a tearing sound which is unpleasant to hear and also lacks the secure feeling of a buckle.

A number of patents show attempts to obtain minimum visible or simplified belt. Representative patents are: U.S. Pat. Nos. 1,345,750 DeBeaumont; 1,213,650 Hutchinson; 1,600,279 Epstein; 3,438,063 Loston; 2,423,668 Weithorn; 2,641,812 Boudreau.

BRIEF STATEMENT OF THE INVENTION

This invention involves basically an elongated band of leather or leather like material in the size and shape normally used for a belt including overlapping ends. In place of the conventional buckle, on the inner end, the outer end has adjacent to its end on it inner and unexposed surface and elongated plate holding an upstanding inwardly extending pin or stud. The plate also includes a pair of reentrant ear portions adjacent to each edge and defining a channel through which the inner end of the belt may pass. The inner end of the belt includes a number of openings anyone of which can engage the upstanding pin. A belt keeper holds the inner end to the belt body.

The plate and all of the fastening means is virtually invisible from the front being located on the inner face of the outer end of the belt. Virtually all holes are covered by the outer end of the belt. In an alternate embodiment, the ear portions are joined to form a flat loop for holding the inner end.

DETAILED DESCRIPTION OF THE INVENTION

Figure 1:
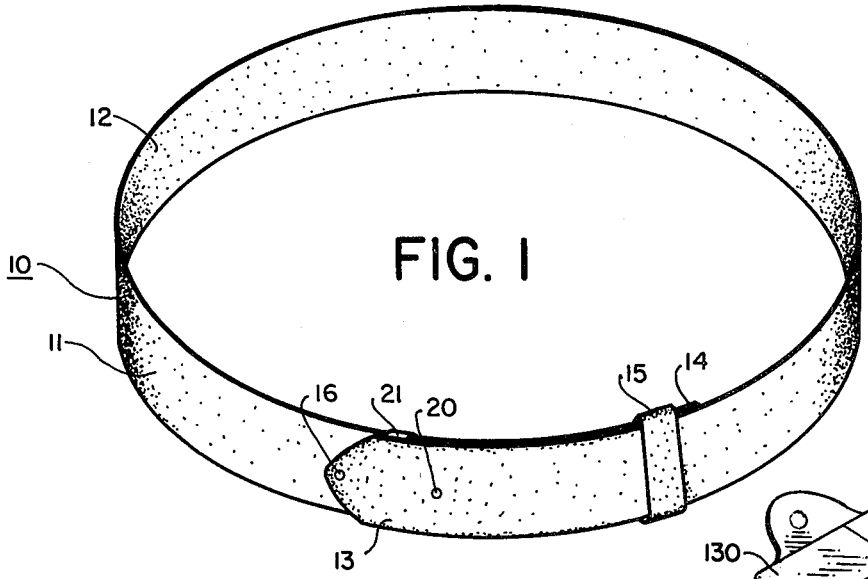
FIG. 1 is a perspective view of a BUCKLELESS BELT in accordance with this invention.

Now referring to FIG. 1, a buckleless belt incorporating this invention may be seen comprising a belt body generally designated 10 having an outer face 11, an inner face 12, a first or outer end 13, and a second or inner end 14. A conventional belt loop 15 appears encircling both the outer end portion 13 and the inner end portion 14.

In contrast to conventional belts, there is no buckle and the outer end 13 is not perforated in the way that most conventional buckle belts include a number of openings, usually spaced in inch apart to allow adjustment. Two fasteners, namely rivets 16 and 20 are optionally present in the outer end 13 to secure the fastening means of the invention to the inner face 12 of the belt body 10 in the end region 13.

Figure 2:
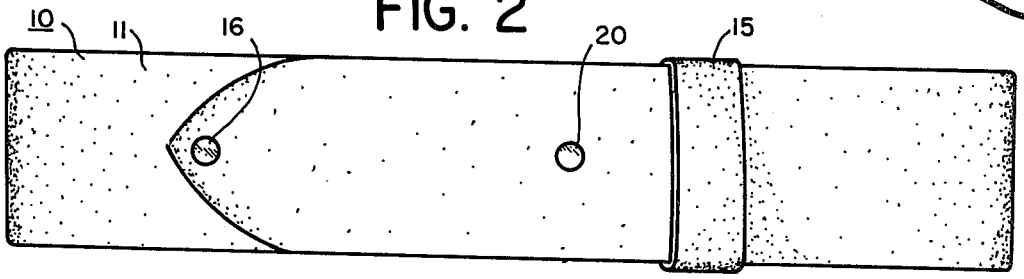
FIG. 2 is a front elevational view thereof.

Rivets 16 and 20 are more clearly seen in FIG. 2 in which the notable absence of visible apertures in the exposed portion of the belt body 10 is a feature of the belt.

Viewed from the front, as in FIG. 2, and likewise to an extent in FIG. 1, there appears to be no visible fastener. As viewed in FIGS. 1 and 2, other than the rivets, 16 and 20 which may be eliminated by other form of concealed fasteners, only a small metal tab 21 appears in FIG. 1. When viewed in FIG. 2, directly in front, the tab 21 in normally not visible or hardly visible at all.

The elimination of visible hardware is particularly important for belts used for law enforcement officers where the typical Sam Browne belt buckle has heretofore been a source of reflection of light at night and a possible target for gun fire. The present invention involving a leather of leatherlike material for the belt and painted rivets 16 and 20 present no shiny metal reflection. The assembly of this invention also provides an extremely light weight belt in contrast with the conventional Sam Browne belt with heavy buckles. Because of the necessary weight of holster and weapon, the elimination of any other weight from the belt is desired.

Heretofore, buckleless belts employing interlocking hook and eye fabric known by the commercial trademark "VELCRO" have been manufactured to eliminate the buckle, however, have not achieved broad acceptance because of significant amount of additional thickness in the belt employing Velcro and the unpleasant tearing sound which is associated with the disengagement of the Velcro material. Also, the lack of positive locking of the belt upon which the officer's weapon and life may depend is not met by the Velcro type buckleless belt.

Figure 3:
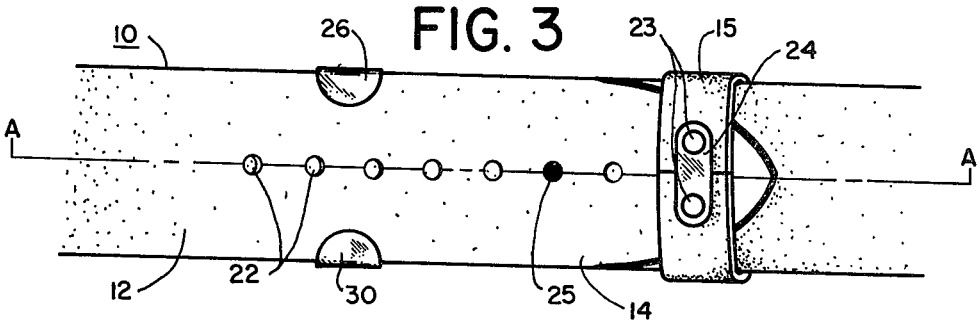
FIG. 3 is a fragmentary inside view thereof, fastened.

Now referring to FIG. 3, the fastening means of this invention may be seen for the first time. The end 14 of the belt body 10 may be seen as including a plurality for example, 7 apertures 22 or belt holes commonly associated with the outer rather than inner end of belts. The loop 15 appears from the rear as a conventional form of loop with the ends held together by a pair of rivets 23 joining a junction plate 24. Alternately, the belt loop may be sewn together.

Each of the openings 22, FIG. 2, with the exception of the second from the right in the drawing are empty. That opening 22 is filled with a fastening element, eg. a pin 25 with its head substantially flush with the surface 12. The pin 25 as will be shown more clearly in FIG. 4 and 6 through 8 is secured to the inner face 12 of the belt body 10 in the end region 13 as shown in FIG. 1. A pair of reentrant tabs 26 and 30 grip the upper and lower edges of the belt body 10 in the end region 14. These tabs 26 and 30 hold the edges of the end region 14 alligned in a vertical direction with the overlying end region 12 of FIG. 1 and also restrains the end region 14 from separating laterally from the end region 13. The tabs 26 and 30 define a channel of sufficient width to receive the belt body thickness without undo restraint from sliding along the longitudinal axis A when the pin 25 is disengaged from any of the aperatures 22. The function of the belt loop 15 is believed apparent on FIG. 3 since it has an opening dimensioned to receive two thicknesses of the belt body, namely the end region 13 and 14. When so positioned as shown in FIG. 3, the belt body region 14 is restrained from separating normal to the paper of the drawing from the end region 13 by the cooperation of the end tabs 26 and 20 and the belt loop 15. Positioned between the tabs 26 and 30, the belt loop is the longitudinal restraint, namely the pin 25. Other than the belt loop 15, none of the other elements are visible from the front as shown in FIG. 2.

Figure 4:
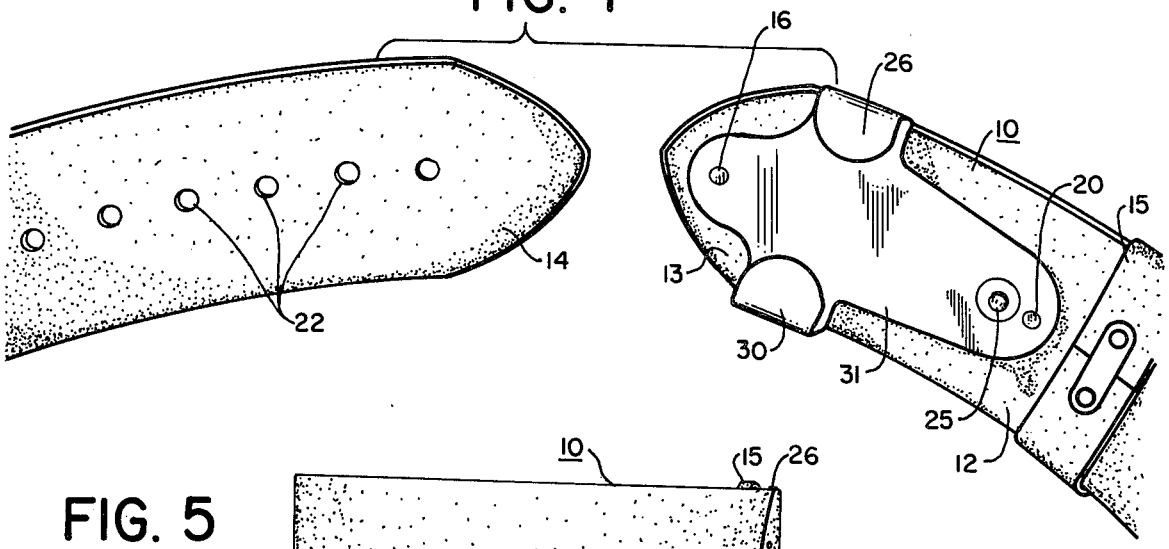
FIG. 4 is a fragmentary inside view thereof, unfastened.

Now referring to FIG. 4, the fastening means may be more clearly seen therein secured to the end region 13 of the belt body 10. The fastening means consist principly of a supporting plate 31 securing the pin 25 in an upright direction. The plate 31 is riveted to the inner face 12 of the belt body 10 by the rivets 16 and 20 of FIGS. 1 and 2. The plate 31 is generally of a cruxiform shape for convenience and of metal such as tempered spring steel. The arms of the plate 31 are folded into reentrant ends to define tabs 26 and 30 with the gap between the body of the plate 30 and the inner surfaces of tabs 26 and 30 respectively of thickness to receive the belt end 14 with minimum play normal to the surface of the plate 31. The tabs 26 and 30 constitute guides along with the head portion of the plate 31 to guide the end portion 14 into the belt loop 15 and into allignment with the belt end 13 so that the openings 22 will be engaged by the pin 25. Any extension of the end 14 beyond the pins 25 falls within the belt loop 15.

Figure 5:
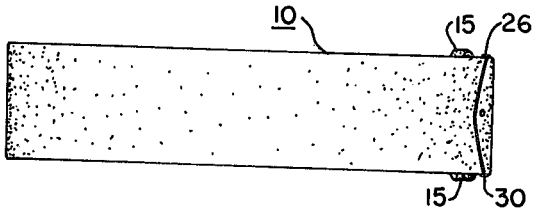
FIG. 5 is a right side elevational view thereof.

The lack of visibility of the fastener in this invention is further illustrated in FIG. 5 which is a side view of the belt. The only visible portions in this view appear to be the belt loop 15 and an insignificant exposure of the tabs 26 and 30.

Figure 6:
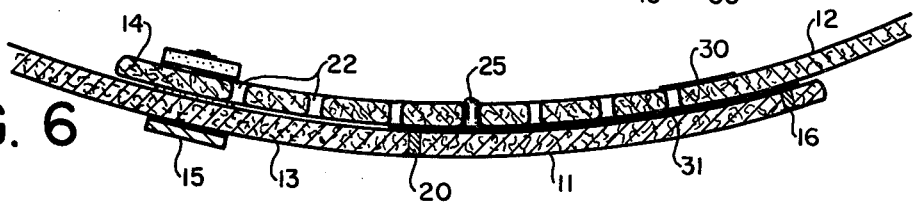
FIG. 6 is a horizontal sectional view taken along line A—A of FIG. 3.

Now referring to FIG. 6 which is a sectional view along the axis A of FIG. 3, the size and relationship of the pin 25 with the openings 22 may be clearly seen. The pin extends no more than 1/16" above the surface 12 and thus provided no discomfort for the wearer or may be flush with surface 12. The rivets 16 and 20 are countersunk so there is no metal protuberance above the surface 11.

The belt loop 15 may be seen in FIG. 6 as maintaining the two end regions 14 and 13 in close proximity to each other. The tab 30 is hardly visible in FIG. 6 as in the plate 31. The extreme slimness of the fastening assembly is particularly apparent in FIG. 6 of the sectional view but likewise apparent in FIG. 8 from which a vertical plan view of the fastener and belt end region may be seen.

Figure 7:
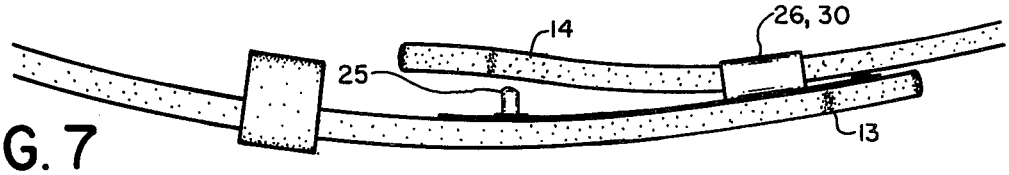
FIG. 7 is a top view while closing thereof.
Figure 8:
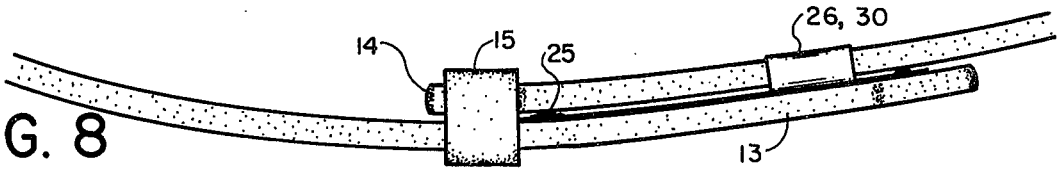
FIG. 8 is a top view while closed.

FIGS. 7 and 8 show the steps of adjusting the belt following the mating of the ends as illustrated in FIG. 4. After the end 14 has passed through the tabs 26 and 30, the end 14 is unrestrained sufficiently that is can pass over the pin 25 until the proper of feeling of tightness if noted by the wearer and slight adjustment will cause the pin 25 to fall in the appropriate aperture 22. This adjustment step appears in FIG. 7. When the proper belt adjustment has been achieved and the pin 25 is in place, the belt loop 15 is slipped over ends 13 and 14 as shown in FIG. 8 and the belt is secured and comfortable and clearly devoid of apparent buckles or fasteners.

In connection with the developments of this belt, one would also note that the holes are now on the under side and this do not present the normal unattractive appearance of a conventional belt. Additionally, we have found that the number of holes in the belt may be increased but still maintaining them virtually invisible throughout the normal range of adjustment. Wherein the past, belts necessarily had to be supplied in 12 different sizes to provide even incremental belt sizes from a 28 inch waist to a 48 inch waist. Now only 6 sizes are required, thus reducing inventory for the retailer and additionally eliminating the need for any change of belt sizes by the officer or wearer unless there is greater than a two inch change in his waist. This is all while maintaining the virtually fastener-free appearance.

Figure 9:
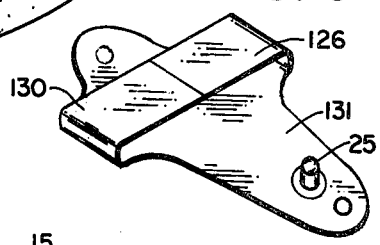
FIG. 9 is a perspective view of an alternate embodiment of the fastener.

As shown in FIGS. 3, 4, and 6, the fastening device employs two individual tabs 26 and 30 formed from arms of the plate 31. An alternate embodiment of the fastener appears in FIG. 9. In FIG. 9, plate 131 is similar to plate 31 of the previous figures except that arms 126 and 130 are joined by a welding at their ends to form a closed loop. This fastening is functionally identical to the fastener described above except that it restrains the belt end 14 across its center section as well as the edges. The embodiment of FIGS. 3 and 4 is preferred since it is lighter in weight and employs less metal in production and eliminates the need for welding.

The above described embodiments of this invention are merely descriptive of its principles and are not to be considered limiting. The scope of this invention instead shall be determined from the scope of the following claims including their equivalent.

What is claimed is:

1. A buckleless belt comprising of a belt body constituting an elongated strip of leather or leather like material and having an outer face, an inner face and a pair of generally parallel edges;

fastener means secured to the inner face of one end region of said belt body;

said fastener means including a fastening device extending outward from the inner face of said belt body;

said belt body in the region of the opposite end from said belt body including a plurality of integral apertures for engagement with said fastening means; and retaining means engaging said belt body for holding regions in fastening engagement wherein said one end region presents substantially no visible fastener means when worn by a person;

wherein said fastener means includes a plate member secured to the inner face of said body and positioning and supporting said pin fastening device in a position extending generally normal to the surface of said plate; and wherein said plate includes integral reentrant arms defining a channel of size to receive the said opposite end of said belt body therein, said reentrant arms including tabs allowing longitudinal movement of said opposite end of said belt while restricting upward or downward movement thereof when worn by a person; said tabs constituting vertually the only portion of said fastener means visible when worn by a person.

2. The combination in accordance with claim 1 wherein said fastening device comprises a pin dimensioned to rest in one of said apertures in the said opposite end of said belt body.

3. The combination in accordance with claim 1 wherein said reentrant arms including said tabs, positioned adjacent to the edge of said belt body and enclosing the edge region only of the opposite end of the belt body;

4. The combination in accordance with claim 1 wherein said pin supported by said plate and said reentrant portions of said plate are longitudinally displaced with respect to each other whereby said pin and said reentrant portions cooperate to secure a major portion of the overlapped ends of said belt body from movement.

5. The combination in accordance with claim 1 wherein said retaining means comprises of metal loop secured to said plate and having a minimum thickness to provide minimum visibility when the belt is viewed from the front of a wearer.

* * * * *